United States Patent [19]

Maekawa et al.

[11] Patent Number: 4,660,962

[45] Date of Patent: Apr. 28, 1987

[54] CLEANING DEVICE

[75] Inventors: Nobuaki Maekawa; Shigeru Shimizu; Masaaki Dohi; Yoji Kuriyama, all of Higashiyamatoshi, Japan

[73] Assignees: Casio Computer Co., Ltd.; Casio Electronics Manufacturing Co., Ltd., both of Tokyo, Japan

[21] Appl. No.: 726,980

[22] Filed: Apr. 25, 1985

[30] Foreign Application Priority Data

Apr. 28, 1984 [JP] Japan ..... 59-87153
Sep. 20, 1984 [JP] Japan ..... 59-195663

[51] Int. Cl.[4] ..... G03G 21/00
[52] U.S. Cl. ..... 355/15; 15/256.51
[58] Field of Search ..... 355/3 R, 15; 15/256.51, 15/256.52

[56] References Cited

U.S. PATENT DOCUMENTS 3,580,673 5/1971 Yang ..... 355/15
3,692,402 9/1972 Solarek ..... 355/15 X
3,781,107 12/1973 Ruhland ..... 355/15
4,006,987 2/1977 Tomono et al. ..... 355/15
4,071,296 1/1978 Ermel et al. ..... 355/15
4,252,433 2/1981 Sullivan ..... 355/15
4,361,922 12/1982 Karal ..... 355/15 X
4,451,139 5/1984 Yanagawa et al. ..... 355/15
4,482,244 11/1984 Yamazaki et al. ..... 355/15
4,506,975 3/1985 Shukuri et al. ..... 355/15
4,515,467 5/1985 Suzuki ..... 355/15
4,533,236 8/1985 Garsin .

*Primary Examiner*—Fred L. Braun
*Attorney, Agent, or Firm*—Sandler & Greenblum

[57] ABSTRACT

The cleaning device includes a conductive fur brush for removing toner remaining on an image carrier, and a conductive retrieval roller for collecting the toner caught by the conductive fur brush. A bias voltage of a polarity reverse to the charged polarity of the toner and the absolute value of which is smaller than 200 V is applied to the conductive fur brush, and a bias voltage of the same polarity as that of the bias voltage applied to the conductive fur brush and the absolute value of which is larger by 200 to 500 V than that of the conductive fur brush is applied to the conductive collective roller.

6 Claims, 8 Drawing Figures

CLEANING DEVICE

BACKGROUND OF THE INVENTION

The present invention relates to an image forming apparatus provided with a conductive fur brush for brushing the surface of a sensitive body.

In the case of conventional electrophotographic copying machines, a toner image is formed on a sensitive body in accordance with well known electrophotographic processes and this image is transferred to a sheet of transfer paper. However, the toner image which is on the sensitive body is not 100% transferred to the transferring paper. Instead, toner in an amount which usually ranges between 20% and 40% is not transferred but is instead left on the sensitive body. When this happens, the toner which remains on the sensitive body after the transfer process must be removed so as not to influence the next such process; and a cleaning device is used to achieve this purpose.

One type of cleaning device which is well known is a fur brush type of cleaner which comprises a rotating conductive fur brush to which a bias voltage has been applied. This brush is then used to brush the surface of the sensitive body to remove any toner remaining on it. However, such a fur brush is continuously subjected to rapid bending stress; so that when it is used for a long period, some of the fur falls off and is broken, and these fur pieces are carried to the downstream side of the machine, following the rotation of the sensitive body and resulting in a variety of problems. The fur may stick to the discharger wire and result in abnormal discharge, or may enter the developer to partially break an image, or may adhere to a sheet of transfer paper to make a copy unacceptable; further, the fur may adhere to the heat roller of the fixer located on the downstream side of the machine and result in contamination of the fixer. Because of the structure of such photocopying machines, it is difficult to prevent the fur from falling and breaking off. This necessitates a member which will prevent the separated fur from being carried throughout and scattered within the machine. Conventional fur brush cleaning devices generally employ a Mylar film or similar material to prevent toner from being scattered, but this is the only purpose it can serve. However stongly the Mylar film may come into contact with the sensitive body, it is not possible for it to shield the broken and separated furs; instead these furs damage the sensitive body to a greater degree. Thus, the fallen or broken furs cannot be prevented from scattering through the machine.

SUMMARY OF THE INVENTION

The present invention therefore intends to eliminate such drawbacks; and the object of the present invention is to provide an image forming apparatus which is simple in construction and capable of preventing fallen brush fur from being scattered in the apparatus.

According to the present invention, this object can be achieved by a cleaning device comprising a conductive fur brush for removing toner left on a image carrier, a conductive collecting roller which collects the toner caught by the conductive fur brush and to which a predetermined bias voltage is applied, and means for scraping the toner collected on the conductive collecting roller. A bias voltage having a polarity reverse to the electrified polarity of the toner and having an absolute value smaller than 200 V is applied to the conductive fur brush; and a bias voltage which has the same polarity as the bias voltage which is applied to the conductive fur brush and an absolute value which is larger by 200 V–500 V than the bias voltage applied to the conductive fur brush is applied to the conductive collecting roller.

DETAILED DESCRIPTION OF THE PREFERRED EMBODIMENTS

Figure 1:
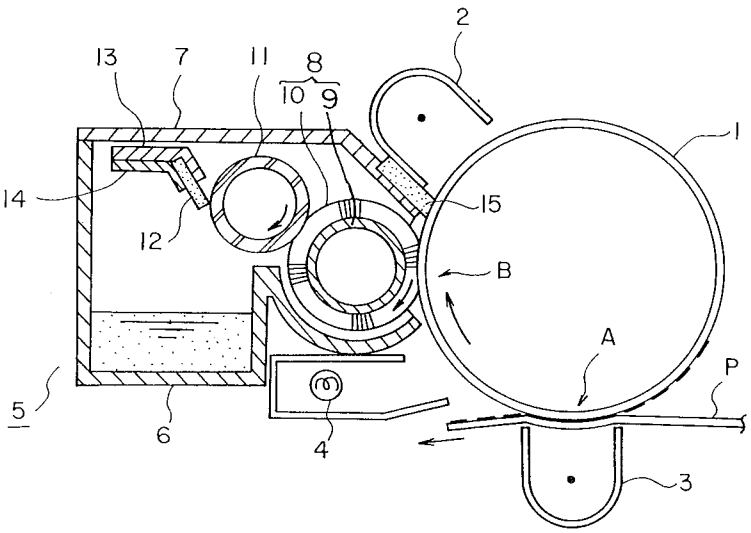
FIG. 1 discloses one embodiment of the present invention.

FIG. 1 is an example of an image forming apparatus formed in accordance with the present invention.

A sensitive body 1 serves as an image carrier and is rotatable in a direction illustrated by the arrow in FIG. 1. Arranged around sensitive body 1 are charger 2, transfer means 3, discharging lamp 4, and cleaning device 5, in that order. Further, an exposing means, a developing means, a fixing means, and a paper supply means, none of which are illustrated in FIG. 1, are located in respective predetermined positions.

Figure 2:
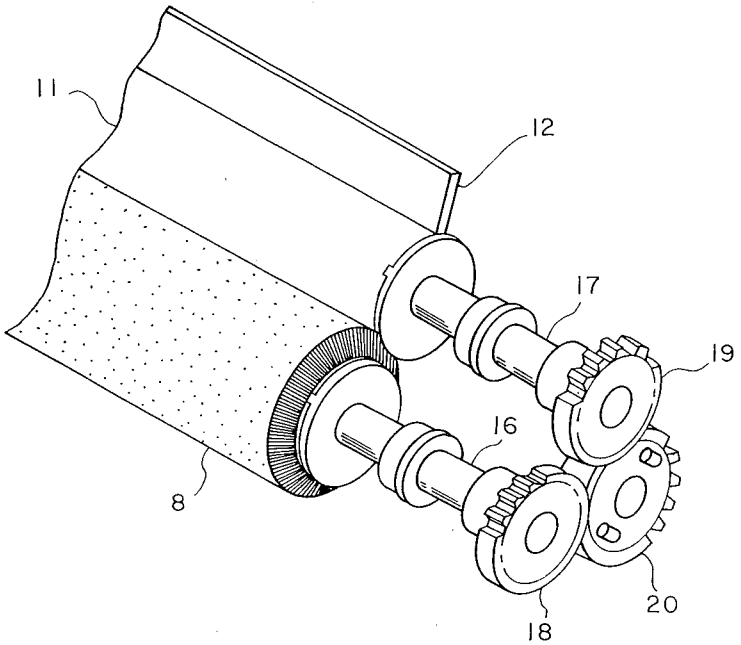
FIG. 2 is a perspective view illustrating a main portion of the present invention of the embodiment of FIG. 1.

Cleaning device 5 comprises a cleaning brush 8, collecting roller 11, and a blade 12 housed in casing 6 to which lid 7 is attached. Gears 18 and 19, which are attached to shafts 16 and 17 of cleaning brush 8 and collecting roller 11, respectively, are engaged with driving gear 20, as illustrated in FIG. 2. This engagement causes cleaning brush 9 and collecting roller 11 to be rotated.

Figure 3:
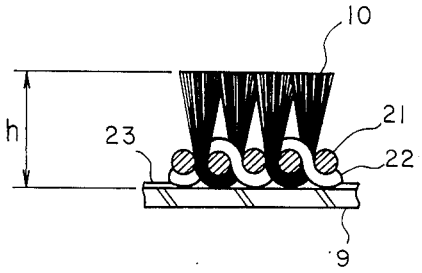
FIGS. 3 and 4 illustrate how the conductive brush fur is woven.
Figure 4:
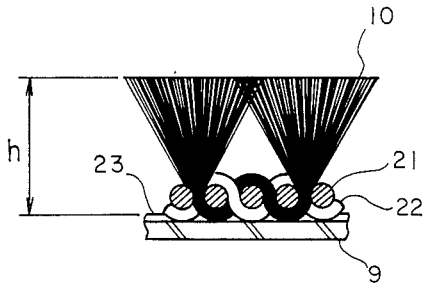

Bundles of conductive brush furs 10 are woven into a basic cloth comprising warp threads 21 and weft threads 22; these furs are then stuck to conductive core 9 through a conductive adhesive layer 23. Such attachment provides electric conductivity between conductive core 9 and conductive brush furs 10, as illustrated in FIGS. 3 and 4. Brush furs 10 are woven into the basic cloth to form either the letter V or W, and the V-shaped weave illustrated in FIG. 3 is intended to bind and fix a bundle of conductive brush furs 10 to the basic cloth, which comprises the warp and weft threads 21 and 22 in a predetermined positioned. At the same time, the W-shaped weave illustrated in FIG. 4 is intended to bind and fix a bundle of conductive brush furs 10 to the basic cloth in two of its positions. Brush furs 10 are preferably formed from a material like rayon, which has a resistivity ranging between $10^7\Omega$cm to $10^{11}\Omega$cm. Each of the the 200 or 300 rayon yarns has 5–6 deniers used as a bundle. Brush fur 10 also preferably has a density of 150,000 yarns/inch$^2$–220,000 yarns/inch$^2$. A conductive core 9 is provided which can comprise a drawn or extruded aluminum or stainless steel pipe, or a paper sleeve which has been subjected to a conductivity treatment. Collecting roller 11 is formed from a material such as aluminum or stainless steel. Blade 12 is fixedly sandwiched between blade holders 13 and 14 and has a forward edge end which is pressed against collecting roller 11. Blade 12 is formed from a rubber-like elastic member having a hardness between 60° and 80° and can particularly comprise urethane rubber which will have desirable abrasion and ozone resistance.

Figure 5:
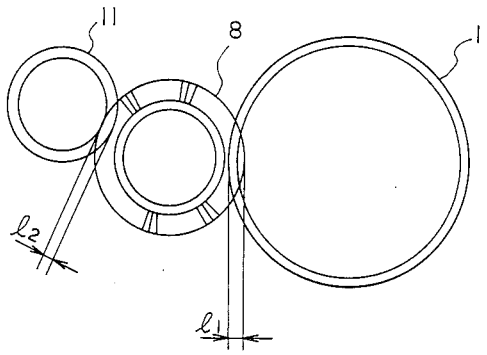
FIG. 5 illustrates how the sensitive body, the cleaning brush and the collecting roller are positioned with respect to each other.

Brush furs 10 have interference distances $l_1$ and $l_2$ with respect to the sensitive body 1 and collecting roller 11 which, in the present embodiment, are as follows:

$l_1 = 1.0 \sim 2.0$ mm; and $l_2 = 1.0 \sim 1.5$ mm (see FIG. 5).

The brush furs 10 have a length h which is dimensioned, in the present embodiment, as:

$h = 4 \sim 6$ mm (see FIGS. 3 and 4).

Sponge member 15 serves to rub the surface of sensitive body 1 andis arranged downstream of cleaning brush 8. Sponge member 15 has its position determined by a recess on lid 7 and is attached to the recess by a double-adhesive tape or similar member and is sandwiched between lid 7 and discharger 2. A foam sponge having a standard cell size more than 40/inch$^2$ is used as sponge member 15.

Figure 6A:
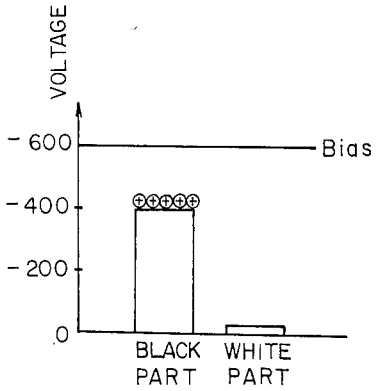
FIGS. 6*A* and 6*b* illustrate the relationship between the potential in the black and white areas on the sensitive body, and the bias voltages applied to the fur brush.
Figure 6B:
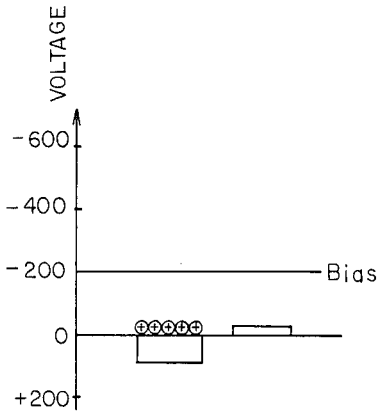
Figure 7:
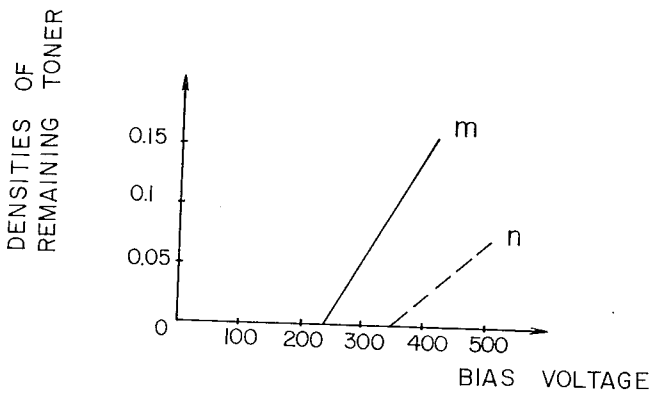
FIG. 7 illustrates the relationship between the density of toner remaining on the sensitive body and the bias voltage.

FIG. 6A and 6B illustrate the relationship between the potential of still-remaining toner on sensitive body 1 and the white area on sensitive body 1, and the bias voltage applied to conductive fur brush 10. FIG. 6A illustrates a situation in which a sensitive body 1 has not been subjected to a discharging treatment jusr before it is cleaned. In this case a high voltage of −400 V remains in the not-transferred and still-remaining toner area, and a first bias voltage of about −600 V is needed to electrically collect the remaining positive polarity toner by using the fur brush. The potential difference becomes large when compared with the white area, and current flows to sensitive body 1 through brush fibers in this case, causing toner to adhere to sensitive body 1. On the other hand, FIG. 6B illustrates another situation in which discharging light treatment is applied to sensitive body 1 prior to cleaning. FIG. 7 is a graph which illustrates the densities of still-remaining toner (or the densities after inferior cleaning) measured after sensitive body 1 is passed over the cleaning section, where the first bias voltage applied to the fur brush is variable when the discharging light treatment is applied to sensitive body 1 just before the cleaning process. In this graph, line (m) represents the density of toner in the still-remaining toner area after inferior cleaning, while line (n) represents the density of toner in the white areas after such inferior cleaning. When the bias voltage is increased, even in the case in which the discharging light has been applied to the sensitive body, inferior cleaning will result. In order to stabilize the cleaning capacity, therefore, it is necessary that the first bias voltage be set lower than −250 V, and preferably between 0 and −200 V in the case of a positive polarity toner. In order to provide collecting roller 11 with stronger electrostatic attraction relative to the toner electrostatically stuck to the fur brush 10, it is naturally necessary that the difference between the second bias voltage applied to collecting roller 11 and the first bias voltage applied to fur brush 10 is made sufficiently large. When it is made too large, however, the substantial potential of the fur brush is raised to effect the phenomenon of attaching the toner reversely. Therefore, it is important that the difference be kept smaller than 500 V, and preferably between 200 V and 400 V. When the first bias voltage is set at −200 V, e.g., it is important that the second bias voltage be set between −400 V and −600 V.

In FIG. 1, a uniform electrostatic charge is applied to a surface of rotating sensitive body 1 through charger 2, and an image on the original is exposed to form an electrostatic latent image which is developed by developing means to form a toner image. The toner image which is formed on sensitive body 1 is then transferred onto a sheet of transfer paper P, which is fed from a paper supply means at a transfer position A and is transferred due to the electrostatic attraction of transfer means 3. Transfer paper P, onto which the toner image has been transferred, is then separated from sensitive body 1 by a separating means (not illustrated), and the image is fixed by the fixing means. Toner which is not transferred but which still remains on sensitive body 1 after the transferring process is irradiated by the discharging lamp 4 as sensitive body 1 is rotated in the direction illustrated in FIG. 1. Charge which still remains on sensitive body 1 is then quickly reduced by light irradiation, and the electrostatic attraction between the surface of sensitive body 1 and still remaining toner is nearly extinguished, thus making it easier for still-remaining toner to become free from sensitive body 1.

The sensitive body is brushed at cleaning position B by conductive brush furs 10 of cleaning brush 8. The cleaning brush is rotated in a direction reversed from the rotation of sensitive body 1 in order to clean still-remaining toner on sensitive body 1. A bias voltage having a plurality reverse from that of the still-remaining toner is applied to brush furs 10 through conductive core 9. This bias voltage is preferably low and ranges between about 50 V to 200 V. Thus, the still-remaining toner on sensitive body 1 is removed from the sensitive body, due to the physical scraping effected by the brushing action of brush furs 10, and also due to electrostatic attraction caused by the applied bias voltage. Toner which has been shifted from sensitive body 1 to brush furs 10 is carried to a point where the brush furs contact the collecting roll 11 as cleaning brush A is rotated in a direction illustrated by the arrow in FIG. 1. The bias voltage which has the same polarity as the bias voltage applied to brush fur 10 and which is higher by 200–500 V than the bias voltage applied to the brush fur is then applied to collecting roller 11. In this way, toner held by brush fur 10 is shifted onto collecting roller 11 due to the electrostatic attraction caused by the bias voltage applied to connecting roller 11 and due to the physical brushing force effected between brush furs 10 and collecting roller 11. The toner which has shifted onto collecting roller 11 is then scraped from the collecting roller by blade 12.

As described above, cleaning brush 8 is rotated in a direction reverse from the rotation of sensitive body 1 during cleaning. Thus, conductive brush furs 10 are usually subjected to rapid bending stress in an area in which cleaning brush 8 brushes sensitive body 1. When used for a long time, conductive brush furs 10 may become loosened annd fall off of the cloth base or can become broken at the areas where they are bent. These fallen or broken conductive brush furs are carried on the downstream side as sensitive body 1 is rotated, but they are completely intercepted by sponge member 15, which is located on the downstream side to brush the surface of sensitive body 1. Thus, conductive brush furs 10 can be prevented from scattering outside cleaning device 5 and from entering charger 2, transfer means 3 and similar structure, thus causing no problem.

A foam sponge having a standard cell size larger than 40/inch$^2$ has been used as sponge member 15 in this embodiment. This foam sponge causes no damage to sensitive body 1, even when it strongly contacts the sensitive body. In addition, it can completely intercept the fallen and broken brush furs. However, the material of sponge member 15 need not necessarily be as in this embodiment.

As described in detail above, an image forming apparatus in accordance with the present invention can be simple in construction and can form stable images without causing any damage to the surface of the sensitive body and without causing image to be influenced by fallen brush furs, because such furs are intercepted completely and are not scattered into the apparatus.

What is claimed is:

1. A cleaning device comprising a conductive fur brush for removing toner left on an image carrier, a conductive collecting roller, means for applying a predetermined bias voltage to said conductive collecting roller in order to collect toner removed by said conductive fur brush, means for scraping toner collected on said conductive collecting roller from said roller, said device further comprising means for applying a bias voltage to said conductive fur brush having a polarity reverse to the charged polarity of said toner and having an absolute value smaller than 200 V wherein said means for applying a bias voltage to said conductive collecting roller apply a bias voltage which is the same in polarity as the polarity of the bias voltage applied to the conductive fur brush and which is larger by between 200 V–500 V, in absolute value, than the bias voltage applied to the conductive fur brush in order to prevent toner collected from said conductive fur brush from re-adhering to said image carrier.

2. A cleaning device in accordance with claim 1 wherein said conductive fur brush comprises a conductive rayon material having a resistivity between $10^7\Omega$cm to $10^{11}$ $\Omega$cm.

3. A cleaning device in accordance with claim 1 wherein said conductive fur brush comprises a polarity of yarns, each of said yarns having 5–6 deniers.

4. A cleaning device in accordance with claim 1 wherein said conductive fur brush has a fur density between 150,000/inch$^2$ to 220,000/inch$^2$.

5. A cleaning device in accordance with claim wherein the interference distances $\mathbf{1}_1$ and $\mathbf{1}_2$ of the brushing furs of said conductive fur brush with respect to said image carrier and with respect to said collecting roller are between 0.1 mm and 2.0 mm and between 1.0 mm and 1.5 mm, respectively.

6. A cleaning device in accordance with claim 1 further comprising a sponge which comprises means for rubbing the surface of said imge carrier on the downstream side of said conductive fur brush, as viewed in the moving direction of said image carrier, and which is located between a recess located on a cover and a charger.

* * * * *